United States Patent [19]

Kondo et al.

[11] Patent Number: 4,479,464

[45] Date of Patent: Oct. 30, 1984

[54] AIR-TO-FUEL RATIO CORRECTING ARRANGEMENT IN A FUEL SUPPLY CONTROL SYSTEM HAVING A FEEDBACK LOOP

[75] Inventors: Toshio Kondo, Anjo; Hideaki Norimatsu; Mitsuo Nakamura, both of Kariya; Akira Masuda, Aichi; Sigenori Kitazima, Kariya, all of Japan

[73] Assignees: Nippondenso Co., Ltd., Kariya; Toyota Jidosha Kogyo Kabushiki Kaisha, Toyota, both of Japan

[21] Appl. No.: 940,388

[22] Filed: Sep. 7, 1978

Related U.S. Application Data

[63] Continuation of Ser. No. 742,914, Nov. 17, 1976, abandoned.

[30] Foreign Application Priority Data

Nov. 24, 1975 [JP] Japan ..... 50-140948

[51] Int. Cl.[3] ..... F02B 33/00

[52] U.S. Cl. ..... 123/489; 123/492; 123/493; 123/440

[58] Field of Search ..... 123/32 EE, 32 EG, 32 EH, 123/32 EL, 32 EA, 119 EC; 60/276, 285

[56] References Cited

U.S. PATENT DOCUMENTS

| | | | |
|---|---|---|---|
| 3,727,591 | 4/1973 | Suda | 123/493 |
| 3,742,920 | 7/1973 | Black | 123/492 |
| 3,875,907 | 4/1975 | Wessel et al. | 123/489 |
| 3,895,611 | 7/1975 | Endo et al. | 123/489 |
| 3,903,853 | 9/1975 | Kizler et al. | 123/489 |
| 3,986,352 | 10/1976 | Casey | 60/276 |
| 3,990,411 | 11/1976 | Oberstadt et al. | 123/489 |
| 3,998,189 | 12/1976 | Aoki | 123/489 |

OTHER PUBLICATIONS

"Closed Loop Carburetor Emission Control System", by R. A. Spilski and W. D. Creps, SAE, pp. 145–154, 1975.

*Primary Examiner*—P. S. Lall

*Attorney, Agent, or Firm*—Cushman, Darby & Cushman

[57] ABSTRACT

The air-to-fuel ratio of a combustible mixture supplied to an engine is controlled by a feedback loop which includes an integration circuit for integrating the output signal of an oxygen sensor which detects the oxygen concentration in the exhaust gases of the engine, to produce an output voltage. The output of the sensor is applied to the integration circuit through a switch which opens in response to predetermined conditions of the engine whereby the output voltage of the integration circuit is held at a value occurring just before the switch opens.

9 Claims, 7 Drawing Figures

AIR-TO-FUEL RATIO CORRECTING ARRANGEMENT IN A FUEL SUPPLY CONTROL SYSTEM HAVING A FEEDBACK LOOP

This is a continuation of application Ser. No. 742,914 filed Nov. 17, 1976 now abandoned.

BACKGROUND OF THE INVENTION

1. Field of the Invention

The present invention relates to an air-to-fuel ratio feedback control system for an internal combustion engine, wherein the air-to-fuel ratio of mixture represented by the concentration of oxygen in the exhaust gases of the engine is detected in the exhaust system and is fed back to the intake system to thereby control the air-to-fuel ratio of mixture supplied to the engine.

2. Description of the Prior Art

In the past, a control system of the above type has been proposed in which in order to clean up the exhaust gases of an internal combustion engine, the concentration of oxygen in the exhaust gases is detected and fed back in such a manner that the air-to-fuel ratio of a mixture supplied to the engine is corrected to a fixed value, e.g., the stoichiometric air-to-fuel ratio. Control by this type of feedback system is particularly advantageous in that the air-to-fuel ratio of the mixture can be automatically controlled at a predetermined value against large variations in external conditions, e.g., the atmospheric pressure, intake air temperature, etc. It has also been confirmed that feedback corrections by integrating the detected value of the air-to-fuel ratio of a mixture is advantageous in increasing the control speed. However, a disadvantage of this system is that if such a feedback control is effected throughout the whole range of operating conditions of the engine, a situation arises in which even during acceleration, full load and other operations where the engine is required to produce a high output power, the mixture is not increased, that is, the air-to-fuel ratio of the mixture is undesirably maintained constant by the feedback control, thus failing to ensure sufficient output power. When the supply of fuel is cut off during the period of deceleration, the prior art feedback control system causes an undesirable situation wherein the mixture is excessively enriched immediately after the termination of the cut-off of the fuel supply this adversely affecting the cleaning of the exhaust gases.

SUMMARY OF THE INVENTION

With a view to overcoming the foregoing difficulty, it is the object of this invention to provide an air-to-fuel ratio feedback control system for an internal combustion engine, wherein during engine operating conditions where there is no need to feedback and correct the air-to-fuel ratio of the mixture, e.g., when the engine output power is increased or during deceleration, the integrated value of the detected value from the air-to-fuel ratio detector is fed back and held at a value occurring just before such particular engine conditions begin, irrespective of any further variations of the detected value, thus providing the desired engine characteristic.

The system of this invention has among its advantages the fact that the system has an excellent exhaust gas cleaning effect when it is used with internal combustion engines having in the exhaust system a three-way catalyst which exhibits a very high purification percentage at around the stoichiometric air-to-fuel ratio.

Another advantage is that when the engine begins to operate in one of the aforesaid predetermined operating conditions, and the feedback control is interrupted, the then current integrated value is maintained with the result that the air-to-fuel ratio of the mixture can be rapidly returned to the stoichiometric one upon restoration to the normal engine operating condition, thus considerably improving the accuracy of control.

DESCRIPTION OF THE PREFERRED EMBODIMENT

Figure 1:
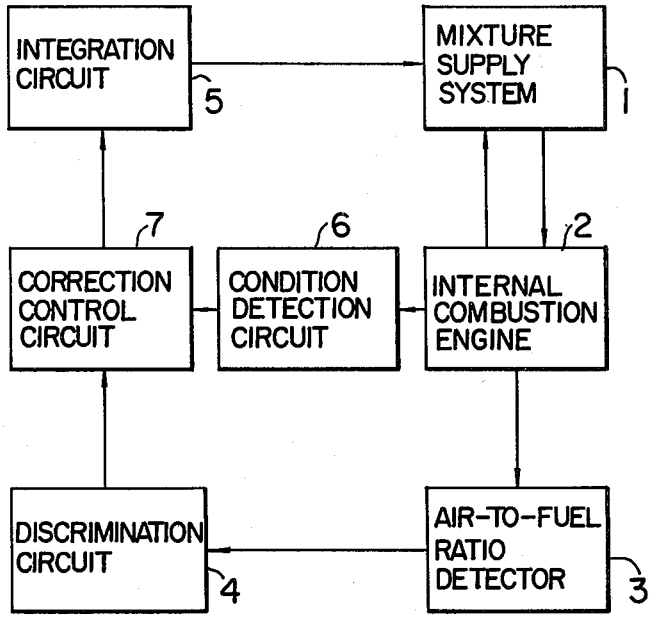
FIG. 1 is a block diagram showing the over-all construction of an arrangement according to the present invention.

The present invention will now be described in greater detail with reference to the illustrated embodiment. In FIG. 1, a mixture supply system 1 includes conventional means, as for example, a carburetor or electronically controlled fuel injection system, for supplying an air-fuel mixture to the intake system of an internal combustion engine 2 at a predetermined air-to-fuel ratio characteristic corresponding to the operating conditions of the engine. An air-to-fuel ratio detector 3 is positioned in the exhaust system of the engine 2. The detector is of the known type which produces a detected value having a step function characteristic corresponding to the concentration of oxygen in the exhaust gases. The feedback system through which the detected value of the air-to-fuel ratio detector 3 is fed back from the exhaust system of the engine 2 to its intake system, comprises a discrimination circuit 4 for comparing the detected value with a desired preset value, an integration circuit 5 for integrating the discrimination value from the discrimination circuit 4 to produce an integrated value having a variation characteristic corresponding to the discrimination value, a condition detection circuit 6 for detecting a predetermined operating condition of the engine 2, and a correction control circuit 7 for controlling the application of the discrimination value from the discrimination circuit 4 to the integration circuit 5. The integrated value from the integration circuit 5 is applied to the mixture supply system 1 which in turn corrects the air-to-fuel ratio of the mixture in accordance with the integrated value, and the correction may be accomplished by any known method such as one in which air or fuel is additionally supplied.

Figure 2:
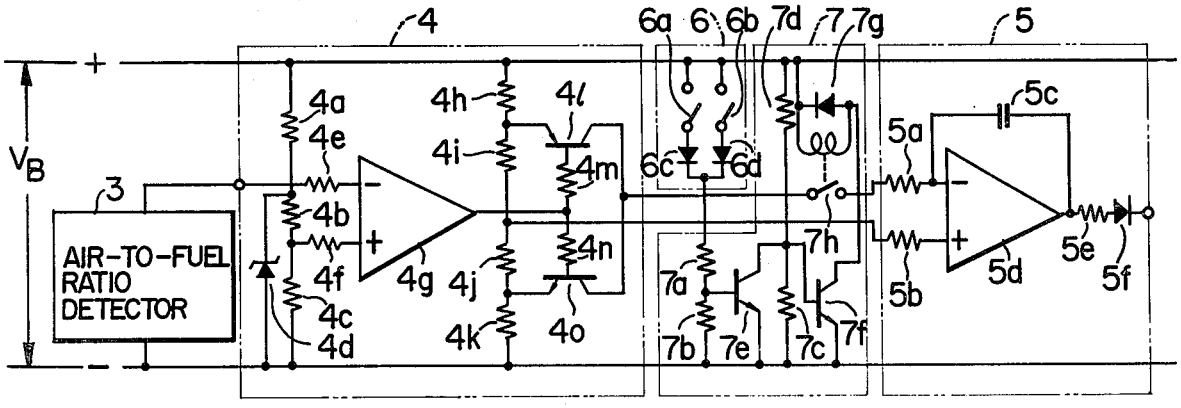
FIG. 2 is a wiring diagram showing a detailed construction of the feedback system employed in the arrangement shown in FIG. 1.

Next, the feedback system will be described in detail with reference to FIG. 2. The discrimination circuit 4 comprises resistors 4*a*, 4*b*, 4*c*, 4*e*, 4*f*, 4*h*, 4*i*, 4*j*, 4*k*, 4*m* and 4*n*, a Zener diode 4*d*, a comparator 4*g* and transistors 4*l* and 4*o*. The inverting input terminal (−) and the noninverting input terminal (+) of the comparator 4*g* respectively receive the output value (the detected value) of the air-to-fuel ratio detector 3 through the resistor 4*e* and the constant voltage developed across the Zener diode 4*d* and divided by the resistors 4*b* and 4*c*, i.e., a preset value, through the resistor 4*f*. When the output voltage of the air-to-fuel ratio detector 3 goes to a low level indicating that the detected air-to-fuel ratio is greater than the stoichiometric one, the comparator 4*g* produces a high level output voltage to turn on the transistor 4*o*, whereas when the output voltage of the air-to-fuel ratio detector 3 goes to a high level, the comparator 4*g* produces a low level output voltage to turn on the transistor 4*l*. The integration circuit 5 comprises resistors 5*a*, 5*b* and 5*e*, a capacitor 5*c*, an amplifier 5*d* and diode 5*f*. The inverting input terminal (−) and the noninverting input terminal (+) of the amplifier 5*d* respectively receive the collector voltage of the transistor 4*l* or 4*o* of the discrimination circuit 4 through the resistor 5*a* and a constant voltage through resistor 5*b* which is obtained by the resistors 4*h*, 4*i*, 4*j* and 4*k*. These resistors divide a supply voltage $V_B$ such that the voltage at the junction of resistors 4*i* and 4*j* is constant at $V_B/2$. The integration circuit 5 produces an increasing integrated voltage (integrated value) during the time that the transistor 4*o* is conducting, whereas it produces a decreasing integrated voltage during the time that the transistor 4*l* is conducting. It is assumed that an integrated voltage equal to $V_B/2$ represents the case when the amount of correction of the air-to-fuel ratio is zero. The condition detection circuit 6 comprises a switch 6*a* and a switch 6*b* which are closed only the the throttle valve (not shown) is in its fully opened position and fully closed position, respectively, and diodes 6*c* and 6*d*. The condition detection circuit 6 produces a high level voltage supplied to the correction control circuit 7 only when the throttle valve is in the fully opened position or fully closed position. Control circuit 7 comprises resistors 7*a*, 7*b*, 7*c* and 7*d*, transistors 7*e* and 7*f*, a diode 7*g* and relay 7*h*. The relay 7*h* inhibits the application to the integration circuit 5 of the collector voltages of the transistors 4*l* and 4*o* in the discrimination circuit 4 when the relay switch is open. This is caused, for example, by the closure of either of the switches 6*a* or 6*b* as can be appreciated from a consideration of FIG. 2. When opening of the relay switch occurs the integrated voltage of the integration circuit 5 is held at the previously attained output level without increase and decrease. Although not shown in any detail, it should be apparent to those skilled in the art that when the temperature of the air-to-fuel ratio detector is below its operating temperature, as for example, during periods of engine starting and warming up, the operation of the integration circuit 5 is prevented so as to disrupt the feedback correction operation.

The operation of the arrangement just discussed will be described with reference to FIG. 3. It is first assumed that the mixture supply system 1 uses an electronically controlled fuel injection system the basic air-to-fuel ratio controlling characteristic of which is preset as shown in (A) of FIG. 3 so that the air-to-fuel ratio of the mixture is held smaller ($\lambda<1$) than the stoichiometric one during the starting and warm-up periods of the engine 2 or when the throttle valve is fully opened. It is also assumed that the injection of fuel is cut off when the throttle valve is fully closed and the engine rotational speed is higher than a preset value. It is further assumed that the air-to-fuel ratio of the mixture is held greater ($\lambda<1$) than the stoichiometric one during normal operation of the engine, and that a fuel quantity proportional to the integrated value from the feedback system is added to the fuel quantity determined in accordance with the basic air-to-fuel ratio controlling characteristic, i.e., the fuel injection time is increased so as to correct the air-to-fuel ratio of the mixture, as shown in (E) of FIG. 3.

When the engine 2 is started at a time $t_o$, the temperature of the air-to-fuel ratio detector 3 is below its operating temperature until the engine 2 warms up to a time $t_1$. During the time period $t_o$ to $t_1$ the basic air-to-fuel ratio characteristic of the mixture supply system 1 remains small ($\lambda<1$) as compared with the stoichiometric air-to-fuel ratio, as shown in (A) of FIG. 3. Consequently, although during this time the air-to-fuel ratio detector 3 produces a high level detected value as shown in (B) of FIG. 3 and the discrimination circuit 4 continously produces a low level discrimination value as shown in (C) of FIG. 3, the integrated value of the integration circuit 5 is maintained at $V_B/2$ since the integration circuit 5 is not in operation during this period. As stated previously, this integrated value $V_B/2$ is indicative of the fact that the amount of correction to the air-to-fuel ratio is zero and thus, the air-to-fuel ratio of the mixture supplied to the engine 2 during the time period $t_0$ to $t_1$ exactly corresponds, to the basic air-to-fuel ratio characteristic, as can be appreciated by a comparison of (E) and (A) of FIG. 3. When the engine 2 begins the normal operation at the time $t_1$, the basic air-to-fuel ratio characteristic of the mixture supply system 1 becomes great ($\lambda<1$) as compared with the stoichiometric air-to-fuel ratio, as shown in (A) of FIG. 3. Consequently, during a time period just after the time $t_1$, the detected value of the air-to-fuel ratio detector 3 and the discrimination value of the discrimination circuit 4 are respectively held at the low level and high level shown in (B) and (C) of FIG. 3 and the integrated value of the integration circuit 5 gradually increases as shown in (D) of FIG. 3. The quantity of ingested fuel is increased in response to the increasing integrated value, and thus the air-to-fuel ratio of the mixture supplied to the engine 2 gradually approaches the stoichiometric one ($\lambda=1$) as shown in (E) of FIG. 3. Thereafter, any slight deviation of the air-to-fuel ratio of the mixture from the stoichiometric one is detected by the air-to-fuel ratio detector 3 so that the quantity of fuel supplied is varied by the mixture supply system 1 in accordance with the deviation, and the air-to-fuel ratio of mixture supplied to the engine 2 is controlled at the stoichiometric one.

Figure 3:
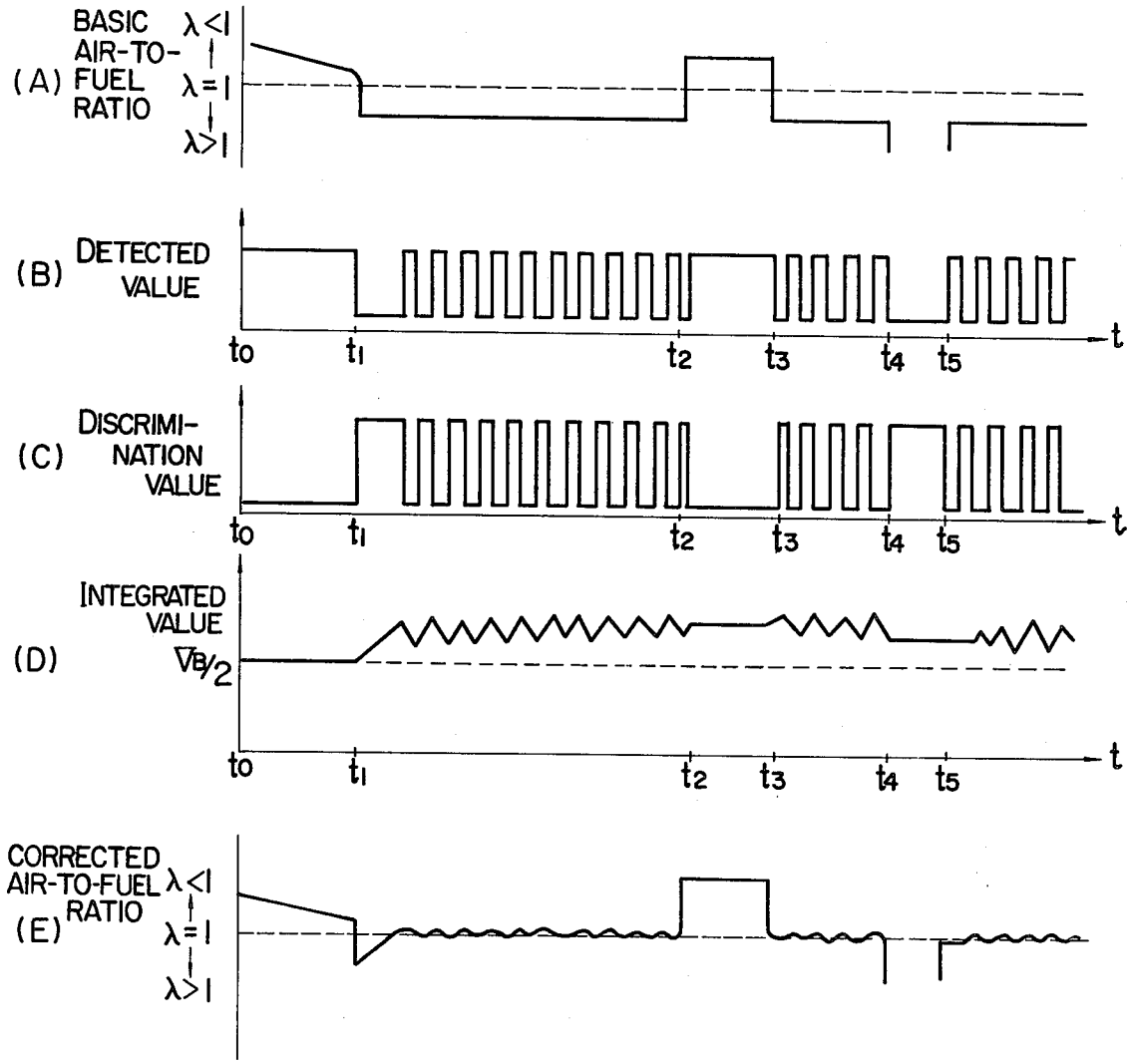
FIG. 3 is a diagram respectively showing in (A), (B), (C), (D) and (E) the basic air-to-fuel ratio characteristic of the mixture supply system, the detected value of the air-to-fuel ratio detector, the discrimination value of the discrimination circuit, the integrated value of the integration circuit and the air-to-fuel ratio characteristic of the mixture supply system after the air-to-fuel ratio correction.

When the throttle valve (not shown) is fully opened at a time $t_2$ so that the engine 2 comes into full load operation, the basic air-to-fuel ratio characteristic becomes small ($\lambda<1$) as compared with the stoichiometric air-to-fuel ratio, as shown in (A) of FIG. 3. Consequently, the detected value of the air-to-fuel ratio detector 3 is maintained at the high level, as shown in (B) of FIG. 3, and the discrimination value of the discrimination circuit 4 is maintained at the low level, as shown in (C) of FIG. 3. However, since the condition detection circuit 6 (by the closure of its switch 6*a*) detects that the throttle valve has been moved into the fully opened position thereby causing the correction control circuit 7 to inhibit the application of the discrimination value of the discrimination circuit 4 to the integration circuit 5, the integration circuit 5 holds its integrated value occurring at the time $t_2$, as shown in (D) of FIG. 3. Thus, the fuel quantity injected by the mixture supply system 1 in accordance with the basic air-to-fuel ratio characteristic is increased by an amount corresponding to the maintained integrated value with the result that the air-to-fuel ratio of mixture is reduced further, as compared to the basic air-to-fuel ratio, and increased engine output power is produced. When the engine 2 returns to normal operation at a time $t_3$ and the condition detection circuit 6 so responds as to permit the switch of relay 7g to close, the feedback system operates in a manner similar as that occurring during the time period $t_1$ to $t_2$. However, while a short time was required for the air-to-fuel ratio of the mixture to attain the stoichiometric one just after the time $t_1$, immediately after the time $t_3$ the air-to-fuel ratio of the mixture is returned to the stoichiometric one. This results from the fact that because of the previous correction of the air-to-fuel ratio of the mixture, the integrated value held from time $t_2$ provides an air-to-fuel ratio of the mixture supplied from the supply system 1 which is very close to the stoichiometric one. Thus, the air-to-fuel ratio of the mixture is corrected just after the time $t_3$ utilizing the retained integrated value. Generally any rapid variations in the atmospheric pressure, intake air temperature, etc., which are important factors necessitating correction of the air-to-fuel ratio of the mixture, do not occur during the comparatively short time period $t_2$ to $t_3$.

As the throttle valve is fully closed at a time $t_4$, the injection of fuel by the electronically controlled fuel injection arrangement of the mixture supply system 1 is interrupted until a time $t_5$ at which the engine rotational speed drops below a predetermined value. Consequently the air-to-fuel ratio of the mixture becomes infinitely great as shown in (A) of FIG. 3. During this period the detected value of the air-to-fuel ratio detector 3 and the discrimination value of the discrimination circuit 4 are respectively held at the low level and high level. The condition detection circuit 6 (by the closure of switch 6b) detects that the throttle valve has been fully closed, and as a result, the correction control circuit 7 inhibits the application of the discrimination value from the discrimination circuit 4 to the integration circuit 5. Consequently, the integration circuit 5 maintains the integrated value occurring at the time $t_4$. During the time period $t_4$ to $t_5$, the fuel injection system stops the injection of fuel notwithstanding the maintained integrated value. As the engine 2 again returns to normal operation after the time $t_5$, the feedback system operates in a manner similar to that occuring during the time period $t_1$ to $t_2$ and $t_3$ to $t_4$, and the air-to-fuel ratio of the mixture supplied to the engine 2 from the mixture supply system 1 is corrected to the stoichiometric one ($\lambda=1$).

With the embodiment described above, the fully opened position as well as the fully closed position of the throttle valve also may be detected in response to the degree of negative pressure at the downstream side of the throttle valve, and moreover, holding of the integrated value during other conditions of the engine, such as rapid acceleration operation, may also be considered if occasions demand.

We claims:

1. An air-to-fuel ratio feedback control system for internal combustion engines comprising:

an air-to-fuel ratio detector positioned in an exhaust pipe of an internal combustion engine and responsive to an exhaust gas component to provide a detection signal indicative of the air-to-fuel ratio of an air-fuel mixture supplied to said engine;

feedback means including a capacitor for performing an integrating operation, said feedback means producing a feedback signal changing in response to change in said detection signal;

condition detector means, coupled to said engine, for generating a condition signal when said engine is in accelerating and decelerating conditions;

correction control means electrically connected between said ratio detector and said feedback means and responsive to said condition signal for interrupting the connection between the detector and said feedback means thereby causing to be maintained on said capacitor a feedback signal having a value occurring just before the generation of said condition signal; and mixture supply means, continously connected to said feedback means to receive said feedback signal, for supplying said engine with an air-fuel mixture having a pre-established air-to-fuel ratio which is corrected in response to said feedback signal, the correction of the air-to-fuel ratio remaining at a constant value determined by the maintained feedback signal, irrespective of changes in said detection signal, while said engine remains in said accelerating and decelerating conditions.

2. An air-to-fuel ratio feedback control system as claimed in claim 1, further comprising:

a discrimination circuit, connected between said ratio detector and the correction control means for comparing said detection signal with a voltage having a predetermined value to produce a discrimination signal; and wherein said feedback means includes an integration circuit, connected to said discrimination circuit and including said capacitor, for integrating the discrimination signal in increasing and decreasing directions in response to the signal level of said discrimination signal to produce said feedback signal.

3. An air-to-fuel ratio feedback control system as claimed in claim 2, wherein said correction control means includes:

a switching element having an input terminal connected to said discrimination circuit and an output terminal connected to said integration circuit, said element interrupting the application of said discrimination signal to said integration circuit when said condition signal is generated.

4. An air-to-fuel ratio feedback control system as claimed in claim 1, wherein said condition detector includes:

throttle responsive means, operatively coupled to a throttle valve of said engine, for generating said condition signal when said throttle valve is opened more than a predetermined amount during acceleration.

5. An air-to-fuel ratio feedback control system as claimed in claim 1, wherein said condition detector includes:

throttle responsive means, operatively coupled to a throttle valve of said engine, for generating said condition signal when said throttle valve is opened less than a predetermined amount during decleration.

6. An air-to-fuel ratio feedback control system for internal combustion engines comprising:

fuel supply means, coupled to an intake side of an engine and having pre-established fuel supply characteristics, for supplying said engine with fuel;

an air-to-fuel ratio detector, coupled to an exhaust side of said engine, for generating a detection signal indicative of oxygen concentration in exhaust gas;

an integration circuit, connected between said air-to-fuel ratio detector and said fuel supply means and including a capacitor, for generating an integration signal which is variable in response to changes in said detection signal, said integration signal being continuously joined to the fuel supply means for correcting the amount of fuel supplied to the engine by said fuel supply means;

a condition detector, coupled to said engine, for generating a condition signal when said engine is in accelerating and decelerating conditions; and a correction control circuit, connected between said ratio detector and said integration circuit and responsive to said condition signal, for interrupting the connection between the detector and said integration circuit whereby said capacitor maintains said integration signal at a value occurring just before said condition signal is generated such that correction of the fuel amount supplied during said accelerating and decelerating conditions is maintained at a constant value determined by the maintained integration signal, irresponsive of changes in said detection signal.

7. An air-to-fuel ratio feedback control system as claimed in claim 6, wherein said condition detector includes:

first means responsive to a throttle valve of said engine and generating said condition signal when said throttle valve is fully opened.

8. An air-to-fuel ratio feedback control system as claimed in claim 6, wherein said condition detector includes:

second means responsive to a throttle valve of said engine and generating said condition signal when said throttle valve is fully closed.

9. In an air-to-fuel ratio feedback control system for internal combustion engines having:

oxygen responsive means for detecting the value of oxygen concentration in exhaust gases discharged from said engine;

means for integrating the value detected by said oxygen responsive means; said integrating means having an output value changing in accordance with changes in detected value;

mixture control means for controlling the air-to-fuel ratio of an air-fuel mixture supplied to said engine, said mixture control means being continuously joined to said integration means and being adapted to correct, in response to the output value of said integrating means, a basic pre-established air-to-fuel ratio of the mixture; and throttle responsive means for detecting accelerating and decelerating conditions of said combustion engine to thereby prevent said basic air-to-fuel ratio from being corrected during said accelerating and decelerating conditions, the improvement comprising:

means responsive to said throttle responsive means for interrupting the integration of the detected oxygen value during said accelerating and decelerating conditions; and memory means for memorizing, during said accelerating and decelerating conditions, the output value of said integrating means occurring just before the beginning of said accelerating and decelerating conditions so that said output value, after the end of said accelerating an decelerating conditions, starts to change from the memorized value, whereby the air-to-fuel ratio of the mixture again is corrected in response to the output of said integrating means.

* * * * *